United States Patent [19]

Gageur

[11] 4,183,451

[45] Jan. 15, 1980

[54] EQUIPMENT FOR TRANSFERRING AN UNSTABLE RUN OF MATERIAL FROM A PROCESSING MACHINE TO A TENTER CHAIN

[75] Inventor: Fritz Gageur, Lindau-Bodolz, Fed. Rep. of Germany

[73] Assignee: Lindauer Dornier Gesellschaft mbH, Fed. Rep. of Germany

[21] Appl. No.: 932,619

[22] Filed: Aug. 10, 1978

[30] Foreign Application Priority Data

Oct. 14, 1977 [DE] Fed. Rep. of Germany ..... 2746174

[51] Int. Cl.[2] ..... B65H 17/28; B65H 17/32

[52] U.S. Cl. ..... 226/91; 226/95; 226/97

[58] Field of Search ..... 226/91, 92, 95, 97, 226/93, 118, 196, 200; 242/195, 76; 198/493, 689

[56] References Cited

U.S. PATENT DOCUMENTS

| | | | |
|---|---|---|---|
| 2,955,732 | 10/1960 | Stobb | 226/95 |
| 3,140,030 | 7/1964 | Stewart | 226/95 |
| 3,643,889 | 2/1972 | Krause | 242/195 |
| 3,733,711 | 5/1973 | Haythornthwaite | 226/95 |

*Primary Examiner*—George F. Mautz
*Attorney, Agent, or Firm*—James E. Bryan

[57] ABSTRACT

This invention relates to an improvement in equipment for transferring an unstable run of material lacking inherent stiffness, for example paper, textiles, poured materials, and the like, from a processing machine including a return roller at a run-of-material discharge to a tenter, the improvement comprising suction carpet means guided by first and second return roller means and adapted to move synchronously with the run of material, guide roller means mounted adjacent said first return roller means at a feed end of said suction carpet means, and air-squeegee means pivotal about the axis of rotation of said guide roller means and pointing at said axis during at least a portion of its pivoting motion.

4 Claims, 1 Drawing Figure

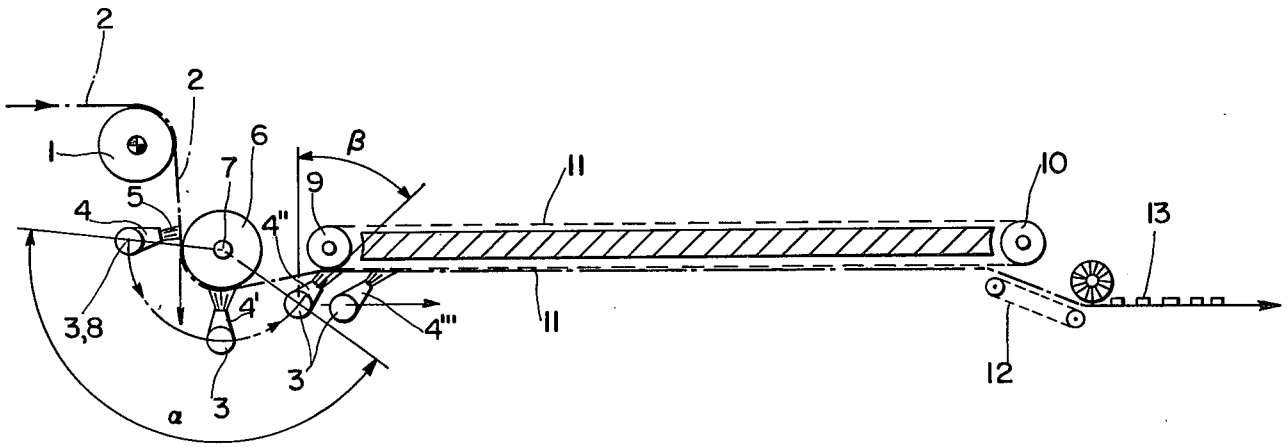
1
2
2
3
3
3,8
4
4'
4''
4'''
5
6
7
9
10
11
11
12
13
α
β

EQUIPMENT FOR TRANSFERRING AN UNSTABLE RUN OF MATERIAL FROM A PROCESSING MACHINE TO A TENTER CHAIN

The invention relates to equipment for transferring an unstable run of material, inherently lacking stiffness (for example paper, textiles, poured materials, and the like) from a processing machine equipped with guide or return rollers at its material outlet to the tenter chain of a transverse tentering frame.

Moving equipment, for example such processing machinery as drying tenter frames, condensing equipment and the like, involves moving the runs of the material being treated from the end of such moving equipment—which may be designed for example as a wire cloth—and turning them around at the end by means of a drive roller, or, in order to avoid imprints from the wire cloth, guiding them over a stationary following roller, whereupon they are fed to a further set of machinery or treating equipment (for example the pressing section, lower level of a multi-level dryer).

It is known in practice to transfer such runs of material manually at low speeds, or to insert a gusset-shaped transfer plate between the machine components to be spanned (for instance between the wire cloth drive and following roller). The space between the two rollers is filled to prevent that the incoming end of the run of material, or in case of rupture, the two sides of it pass between them. To prevent such occurrence and clogging, blow apertures are provided in the transfer sheet, which impinge a jet against the lower side of the run of material moving above.

The functioning of such transfer plates however is fairly reliable only in the case of dry and stable runs of materials. When on the other hand runs of materials composed of soft, wet, coated or unstable substances (for example paper, textiles, poured substances or the like) are made to pass at high speeds through processing machinery, problem-free transfer from one roller to another or to a tenter chain (for example a hammer or needle clip-chain) no longer is possible because the gap between the two rollers or between the roller(s), the following tenter chain and the transfer plate inevitably leads to clogging. The low inherent stiffness of the run of material eliminates its gliding onto the transfer plate whereby it would reach the following roller. Further, the larger the gap between two neighboring rollers or from the discharge roller to the tenter chain, the greater is the problem in overcoming these difficulties.

Considering the drawbacks cited above, it is the purpose of the present invention to provide equipment allowing reliable and problem-free transfer of special runs of materials of low inherent stiffness from one roller to the next or to a tenter chain. Furthermore, the purpose of the invention is to make automatic transfer possible and the distance involved in transferring from roller to roller or from roller to tenter chain practically is no significant factor.

The advantage of the invention is especially that the run of material passing vertically downwardly from the second last guide roller is pressed against the surface of the last return roller by the air or gas jet issuing from an air-squeegee capable of pivoting to that end about a given angle, the jet issuing from nozzle(s) pointed radially toward the axis of rotation of the last return roller, so that this run of material or its incoming end is lifted toward the following suction carpet moving in synchronism with the run of material. The air-squeegee in the process pivots laterally or underneath from the second-last to behind the last return roller, or as far as the first return roller on which the suction carpet is being guided. The output nozzle(s) of the air-squeegee in the process pivot(s) in such manner about the squeegee's axis of rotation that it (they) blow(s)—when operation begins, that is when the run of material is discharged from the second-last guide roller—slightly upwardly against the run of material and when reaching the suction carpet in the direction of its motion. This reinforces the transmission effect of the run of material from one roller to the next and increases pressure against the suction carpet. When the suction carpet has seized, i.e., lifted the run of material, the material is carried and guided as far as the intake and gripping location of the tenter chain. In this manner a continuous transfer of the run of material is made possible also in the case of enclosures sealed because of danger of toxicity and also in evacuated chambers.

The drawing shows one embodiment of equipment for transferring an unstable run of material, lacking inherent stability, from a processing machine provided with return rollers at its material outlet to a tenter chain.

The run of material, i.e. its incoming end 2 issuing from a processing machine (not shown in further detail) off of a second-last guide roller 1 and moving vertically downwardly (see arrow) is pressed by an air or gas get 5 issuing from a nozzle 4 mounted to an air-squeegee 3 against the surface of a last guide roller 6 mounted below the guide roller 1. In the process, the air-squeegee 3 together with its nozzle 4 pivots about the axis of rotation 7 of the guide roller 6 by an angle of rotation $\alpha$ (for example 145°), the rate of rotation of the air-squeegee 3 and the speed of issuance of the run of material 2 being synchronous. During the pivotal motion of the air-squeegee through the angle $\alpha$, the nozzle 4 of the air-squeegee 3, in other words the issuing air or gas jet 5, will be optimally trued toward the run of material 2 (compare also positions 4,4',4'',4'''). To that end, the air-squeegee 3 which initially was pointing with its nozzle 4 slightly upwardly toward the run of material will pivot by an angle $\beta$ about its axis of rotation 8. When the pivotal motion through the angle $\alpha$ is terminated, the air-squeegee 3 is displaced approximately as far as behind the first of two return rollers 9,10 for a suction carpet 11 guided thereon and moving in synchronism with the run of material 2 (see arrow). Nozzle 4, i.e., the air-squeegee 3 then assumes the positions 4'' and 4''', the issuing jet of air or gas 5 being pointed in the direction of motion of the run of material 2 (see arrow). The run of material 2 simultaneously is affected by the suction from the suction carpet 11, lifted, and made to rest. In this manner the suction carpet 11 moves the run of material 2 to the second return roller 10, where it detaches for lack of suction and is transferred by means of a subsequent moving unit 12 into a tenter chain 13 (for instance a needle or hammer clip chain).

It will be obvious to those skilled in the art that many modifications may be made within the scope of the present invention without departing from the spirit thereof, and the invention includes all such modifications.

What is claimed is:

1. In equipment for transferring an unstable run of material lacking inherent stiffness, for example paper, textiles, poured materials, and the like, from a processing machine including a return roller at a run-of-material discharge to a tenter, the improvement comprising suction carpet means guided by first and second return roller means and adapted to move synchronously with the run of material, guide roller means mounted adjacent said first return roller means at a feed end of said suction carpet means, and air-squeegee means pivotal about the axis of rotation of said guide roller means and pointing at said axis during at least a portion of its pivoting motion.

2. Equipment according to claim 1 including means whereby said air-squeegee means is pivotal about its own axis of rotation.

3. Equipment according to claim 1 including means whereby said air-squeegee means, following its pivoting motion, may be displaced about as far as past said first return roller means.

4. Equipment according to claim 3 in which the rate of pivoting and displacement of said air-squeegee means is synchronous with the speed of the run of material.

* * * * *